US005657489A

United States Patent [19]

Ponstein

[11] Patent Number: 5,657,489

[45] Date of Patent: Aug. 19, 1997

[54] BLANKET WITH HEAD AND HAND OPENINGS

[76] Inventor: Todd M. Ponstein, 6601 Wilshere, Jenison, Mich. 49428

[21] Appl. No.: 577,825

[22] Filed: Dec. 22, 1995

[51] Int. Cl.[6] ..... A41D 3/08

[52] U.S. Cl. ..... 2/69; 2/88

[58] Field of Search ..... 2/69, 69.5, 88, 2/89; D2/823–826; 5/495, 413 R, 482

[56] References Cited

U.S. PATENT DOCUMENTS

| | | | |
|---|---|---|---|
| 4,535,479 | 8/1985 | Paula | 2/69.5 |
| 4,752,971 | 6/1988 | Meserol . | |
| 5,206,958 | 5/1993 | Widenback . | |
| 5,400,437 | 3/1995 | Koutras | 2/69 |
| 5,414,881 | 5/1995 | Terrazas . | |

*Primary Examiner*—C. D. Crowder
*Assistant Examiner*—Gloria Hale
*Attorney, Agent, or Firm*—Goldstein & Associates

[57] ABSTRACT

A blanket device comprising a rectangular panel having at least one head accommodating opening sized for allowing a head to be inserted therethrough, and at least one pair of hand accommodating openings shaped for allowing a pair of hands to be inserted therethrough. An elastic cuff is secured to the panel around each of the head and hand accommodating openings so as to nearly or completely cover the openings. When a head or hand is inserted through one of the openings, the cuff conforms closely to the inserted portion of the body so as to prevent cold air and wind from passing through the opening.

8 Claims, 2 Drawing Sheets

BLANKET WITH HEAD AND HAND OPENINGS

BACKGROUND OF THE INVENTION

1. Field of the Invention

This invention relates generally to blankets and more particularly to an improved blanket device that can be worn by one or more persons in such a way that wearers' head and hand movements are not restricted.

2. Description of Related Art

Invention and use of blankets are well known to the public, as they are commonly employed as a means by which to keep warm. However, typical blankets are ill suited for use in covering persons who do not intend to remain still while utilizing the blanket, as such blankets do not allow access to the hands. This problem is especially acute when the blanket is used in an outdoor setting, such as a sporting event, when it is often too cold to comfortably remove the blanket, and yet it is difficult to remain completely beneath the blanket because the wearer needs frequent access of the hands to hold food, drinks, programs, etc.

In an attempt to remedy this problem, ponchos, such as that disclosed by U.S. Pat. No. 5,206,958 to Widenback and U.S. Pat. No. 4,752,971 to Meserol, have been invented. These poncho devices comprise a rectangular piece of fabric with a centralized hole through which to place the head and a hood to cover the head. Unfortunately, such poncho devices are plagued with numerous problems. First of all, they do not provide a separate slot through which to place the hands, but rather are simply configured so that the poncho drapes over the shoulders and does not fit closely around the wearer's arms or hands. While this open configuration allows the wearer to move the arms and hands freely, it also allows cold air and wind to blow through the poncho. In addition, these poncho devices are significantly flawed in that they are capable of accommodating only a single person. However, at social events such as football games, it is very common for two people, or even an entire family, to share a single blanket, as it is burdensome to carry a separate blanket for each person. Perhaps the biggest disadvantage of these prior art devices is that, because of the positioning of the head hole and hood, they are limited to use as a poncho only, and cannot be also used to as a blanket.

There are many other similar poncho variations in the prior art that are designed specifically to meet the needs of wearers at outdoor events. For example, U.S. Pat. No. 5,414,881 to Terrazas discloses a stadium blanket, waterproof covering and cushion. The device has a sheet-like body with a waterproof top layer, a flannel bottom layer and a waterproof hood that can be put in a sealable pocket. A cushion layer is sewn between the two layers so that when the user is seated, the cushion is appropriately placed. However, such devices, having a basic poncho configurations, are also plagued by the above listed problems, and thus are not fully capable of meeting the needs of active wearers.

Thus there is a clear need for an improved blanket device that allows the wearer full use of the hands while still effectively and fully covering the body. Such a blanket would preferably be constructed to accommodate two or more people, and it would easily serve as a standard blanket as well. The present invention fulfills these needs and provides further related advantages as described in the following summary.

SUMMARY OF THE INVENTION

It is an object of the present invention to provide an improved blanket device that allows a person to freely move their head and hands while still fully covered by the blanket. This is a significant advantage of the present invention, as it allows the wearer to easily perform a variety of tasks, such as clapping, eating, drinking or writing, without removing the blanket. Thus it is another object of the present invention to provide a blanket device that, unlike blankets currently available, effectively covers and warms the wearer regardless of the wearer's head and hand movements.

The present invention is an improved blanket device comprising a panel that has head and hand accommodating openings sized and positioned to receive the head and hands of the wearer. A cuff is secured to and extends from the panel around each opening.

It is another object of the present invention to provide cuffs constructed of an elastic material so that the cuffs stretch to allow head and hands to be positioned through the opening. The cuffs thus not only prevent cold air and wind from traveling through the openings and contacting the wearer, but they also effectively cover and protect the wearer's neck and forearms or wrists.

It is an object of the present invention to provide cuffs that extend completely over the head and hand openings so that the blanket device does not have any exposed openings and thus may alternately be utilized as a traditional blanket providing full protection to the body.

It is yet another object of the present invention to provide a series of head and hand accommodating openings, thus allowing a single blanket device to be utilized by a couple or an entire family. This is a significant advantage, as it is often difficult to carry enough blankets to thoroughly cover every member of the family.

It is still another object to provide a team name or logo on the panel of the blanket so that blanket device can also serve as a banner at a sporting event or the like.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWING

In the drawings, like elements are depicted by like reference numerals. The drawings are briefly described as follows.

DETAILED DESCRIPTION OF THE PREFERRED EMBODIMENT

Figure 1:
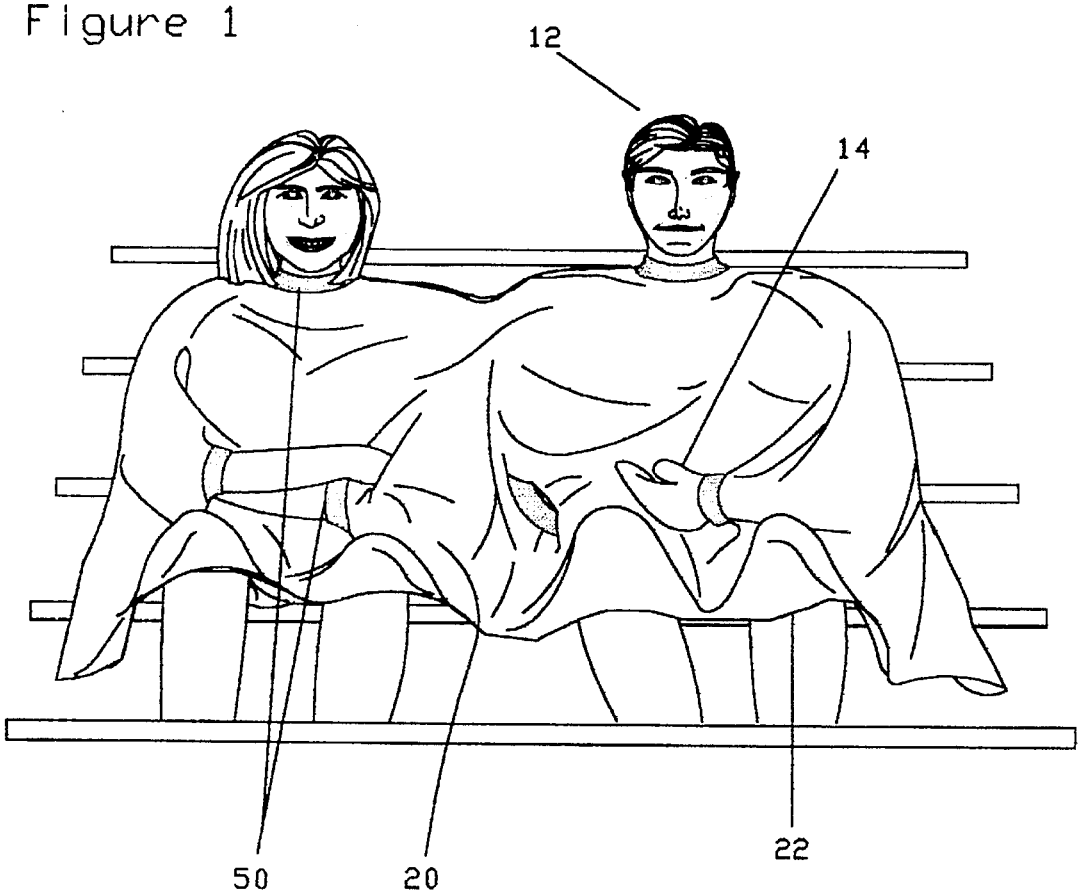
FIG. 1 is a perspective view of the preferred embodiment of the present invention, particularly showing the blanket device as simultaneously worn by two people.
Figure 2:
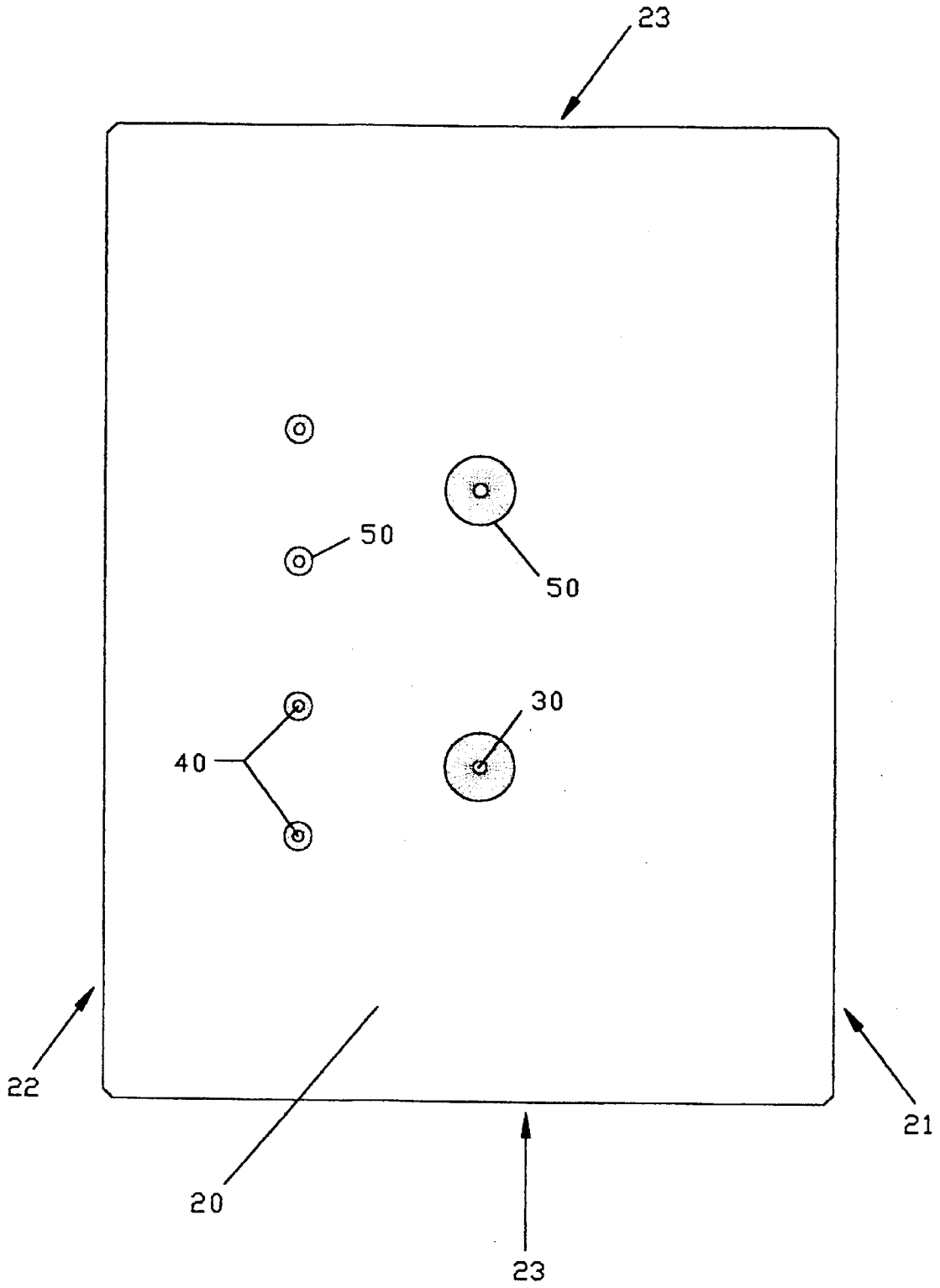
FIG. 2 is a top plan view of the invention, particularly showing the positioning of head and hand accommodating openings in a panel.

FIGS. 1 and 2 show the present inventive blanket device for use in covering one or more people in a manner that allows for unrestricted movement of their heads 12 and hands 14. As clearly seen in FIG. 2, the device comprises a rectangular panel 20 having a top, bottom and two side edges, 21, 22 and 23, respectively. The panel 20 may be constructed of any number of materials, such as wool or other warm, durable fabric. In one embodiment (not shown) a team nee or logo is printed the panel 20 so that the blanket device also serves as a banner at sporting events or the like.

FIG. 2 illustrates that at least one head accommodating opening 30 and at least one pair of hand accommodating openings 40 are positioned in the panel 20. Preferably, the blanket device includes two or more head accommodating openings 30, and two or more pairs of hand accommodating openings 40 so as to allow a single blanket device to be utilized by two or more simultaneous wearers. In this embodiment, one pair of hand accommodating openings 40 are provided for each head accommodating opening 30. The head and hand accommodating openings, 30 and 40 respectively, are preferably circular in shape, with each of the head accommodating openings 30 having a diameter appropriate for allowing a head 12 to be inserted therethrough and each hand accommodating opening 40 having a diameter appropriate for allowing a hand 14 to be inserted therethrough.

As also clearly seen in FIG. 2, the hand-accommodating openings 40 are positioned between the head accommodating openings 30 and the bottom edge 22 of the panel 20. The hand accommodating openings 40 of each pair are spaced apart from one another and centered beneath the corresponding head accommodating opening 30. Thus, as seen in FIG. 1, when the wearer positions the head 12 and hands 14 through the appropriate openings, the top edge 21 of the panel rests against a back portion of the wearer's body, the bottom edge 22 of the panel rests against a front portion of the wearer's body and each of the side edges 23 rest along one side of the wearer's body.

Preferably, the distance between the pair of hand accommodating openings 40 and the corresponding head accommodating opening 30 is greater than or equal to the distance between the two hand accommodating openings 30. Although the exact distances can vary upon construction, the distance between the hand accommodating openings 40 and the corresponding head accommodating opening 30 is great enough to allow wearers to comfortably rest their hands 14 by their sides without pulling the panel 20 taut between the head 12 and hands 14, as clearly illustrated in FIG. 1. Likewise, the distance between the pair of hand accommodating openings 40 is such that wearers can comfortably rest their hands 14 by opposing sides of the body without pulling the panel 20 taut between the two hands, as seen in FIG. 1.

FIG. 2 illustrates the placement of cuffs 50 that are secured to the panel 20 around each of the head and hand accommodating openings, 30 and 40, respectively. Preferably, the cuffs 50 nearly or completely cover the openings when heads 12 and hands 14 are not inserted therein. The cuffs 50 are preferably constructed of an elastic material, such as rib-knit fabric, so that they are easily stretchable to allow head or hands to be inserted through the openings 30 and 40. Once inserted, the cuffs 50 return to their initial state, thus conforming closely around a wrist, forearm or neck of the wearer, as clearly seen in FIG. 1. Also shown in FIG. 1, when one of the hand accommodating openings 30 is not used, the cuff 50 surrounding the hand accommodating opening 30 stays almost completely closed, to prevent heat from escaping or cold air from entering the panel 20.

In conclusion, herein is presented a blanket device for covering the body of one or more persons in such a way that the head and hands of the wearers extend out of the blanket and are thus able to move freely. While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A blanket for covering at least one person in a manner that does not restrict movement of their head and hands, the blanket device comprising a rectangular panel, the panel having a top, a bottom, and a pair of side edges, the panel having:

at least one head accommodating opening positioned in the panel, the at least one head accommodating opening having a diameter great enough to allow a head to be inserted therethrough;

at least one pair of hand accommodating openings positioned in the panel between the at least one head accommodating opening and the bottom edge of the panel, each of the hand accommodating openings having a diameter great enough to allow a hand to be inserted therethrough; and a cuff secured to the panel around each of the head and hand accommodating openings, the cuffs extending outwardly from the panel over and nearly covering the openings when the wearer's head and hands are not inserted therein.

2. The blanket of claim 1, wherein one pair of hand accommodating openings are provided for each head accommodating opening.

3. The blanket of claim 2, wherein the hand accommodating openings of each pair are spaced apart from one another and centered beneath the head accommodating openings.

4. The blanket of claim 3, wherein the distance between the head accommodating opening and the pair of hand accommodating openings is equal to or greater than the distance between the two hand accommodating openings.

5. The blanket of claim 1, wherein the cuffs are constructed of an elastic fabric.

6. The blanket of claim 5, wherein the cuffs are large enough to completely cover the head and hand accommodating openings.

7. The blanket of claim 1, having two head accommodating openings, and having two pairs of hand accommodating openings.

8. The blanket of claim 1, wherein the panel is constructed of wool.

* * * * *